United States Patent [19]

Kovasna et al.

[11] Patent Number: 4,666,388

[45] Date of Patent: May 19, 1987

[54] COLLAPSIBLE FORM AND DEVICE FOR REMOVING FORM FROM CAST CONCRETE

[75] Inventors: Lars Kovasna, Enköping; Gunnar Hörnberg, Ramnäs, both of Sweden

[73] Assignee: Adema Maskin AB, Upsala, Sweden

[21] Appl. No.: 776,043

[22] PCT Filed: Jan. 29, 1985

[86] PCT No.: PCT/SE85/00042

§ 371 Date: Aug. 29, 1985

§ 102(e) Date: Aug. 29, 1985

[87] PCT Pub. No.: WO85/03542

PCT Pub. Date: Aug. 15, 1985

[30] Foreign Application Priority Data

Jan. 31, 1984 [SE] Sweden ..... 8400480

[51] Int. Cl.[4] ..... B28B 7/30; B28B 13/04

[52] U.S. Cl. ..... 425/62; 249/39; 249/66 R; 425/438; 425/440

[58] Field of Search ..... 249/39, 66 R, 207; 425/62, 63, 438, 440, 444

[56] References Cited

U.S. PATENT DOCUMENTS

| | | | |
|---|---|---|---|
| 2,557,631 | 6/1951 | Callan | 249/39 |
| 3,827,840 | 8/1974 | Kistler | 425/62 |
| 4,078,759 | 3/1978 | Lanier | 425/62 |

FOREIGN PATENT DOCUMENTS

| | | | |
|---|---|---|---|
| 2176167 | 10/1973 | France . | |
| 0154435 | 3/1982 | German Democratic Rep. | 249/39 |
| 4004803 | 1/1984 | Sweden . | |

*Primary Examiner*—Jay H. Woo
*Assistant Examiner*—James C. Housel
*Attorney, Agent, or Firm*—Witherspoon & Hargest

[57] ABSTRACT

Apparatus for forming an opening, such as a window or door, in a concrete structure comprises a form and a device for removing the form from the formed structure. The form has operating members and tension bars for collapsing the sides of the form inwardly. The device comprises a stand having a pair of adjustable length beams carrying hydraulically actuated claw members at their ends for engaging the interior of the form.

2 Claims, 8 Drawing Figures

COLLAPSIBLE FORM AND DEVICE FOR REMOVING FORM FROM CAST CONCRETE

The invention relates to a method of making openings, such as those for a window or door or the like when casting a concrete structure, e.g. a cast-in-situ wall, by utilizing a rigid, reusable form made from a frame with a smooth exterior surface. The method involves the form being loosened from the cast concrete structure and being taken out of the opening formed by it. By "rigid form" is intended that the form is rigid during use but may be dismantled, e.g. for storage.

The apparatus for carrying out the method includes a re-usable form made from bar sections, and means for removing the form from the opening formed during casting.

The Swedish patent application No. 84 00480-3 describes a method and apparatus of the kind mentioned above. A certain disadvantage with the technique known from this patent application is that the form must be relieved, i.e. its walls must be slightly sloping to allow it to be removed from the cast wall opening with the aid of the removal means described in the patent application. The form binds very solidly in the opening and large force is required to remove it. This may result in that the form and/or the concrete surface may be damaged if circumstances are unfavourable.

The present invention is directed to providing a method and apparatus of the kind described in the introduction, with the aid of which the form may be easily released from the cast opening without being subjected to impermissibly large forces. Furthermore, the form does not need to have relief, which makes it possible to have the opening square to the cast wall, i.e. without the slightly tapering shape. The characterizing features of the invention are apparent from the accompanying claims. The French patent No. 2,176,167 describes an apparatus intended to be used in casting heavily tapering concrete blocks without demands on dimensional accuracy and surface finish. The blocks are cast in a square form, the walls of which incline towards each other, i.e. the form is pyramidal. The form is released with the aid of gripping claws, using a jack which bears against the ready concrete block, to pull the form away from it. The pulling forces are directed substantially parallel to the chief plane of the form. It will be understood that the necessary pulling forces are considerable, in spite of the form having relief.

Figure 1:
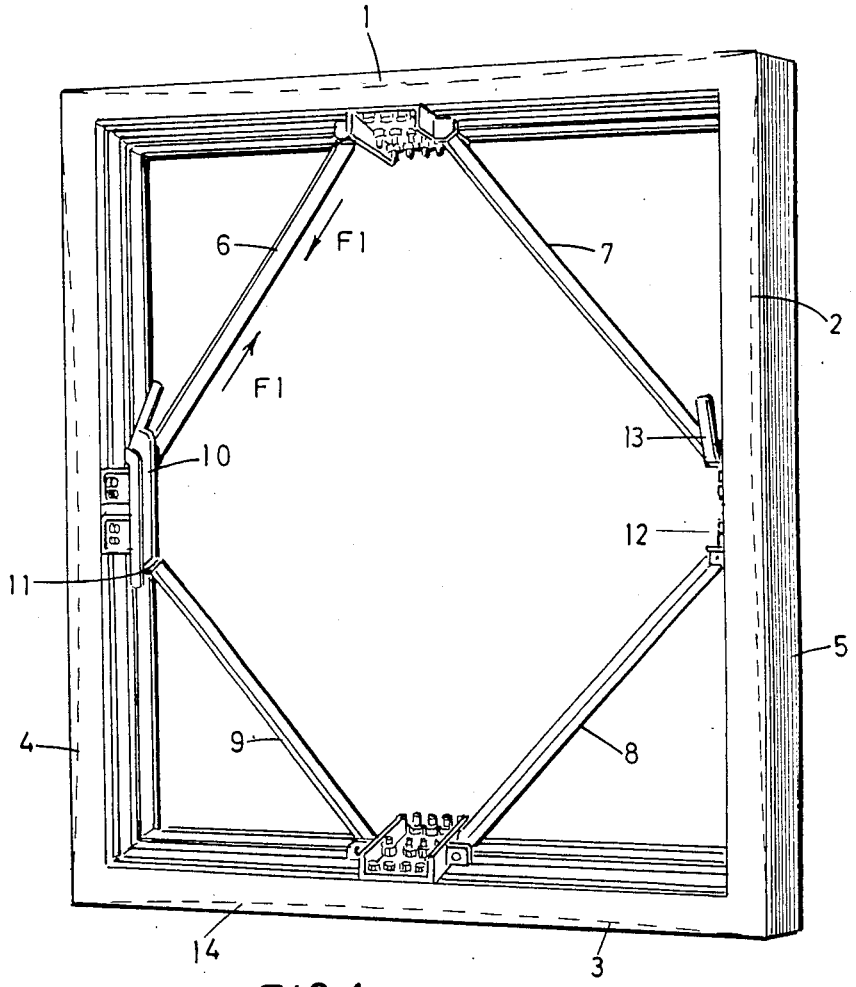
Figure 2:
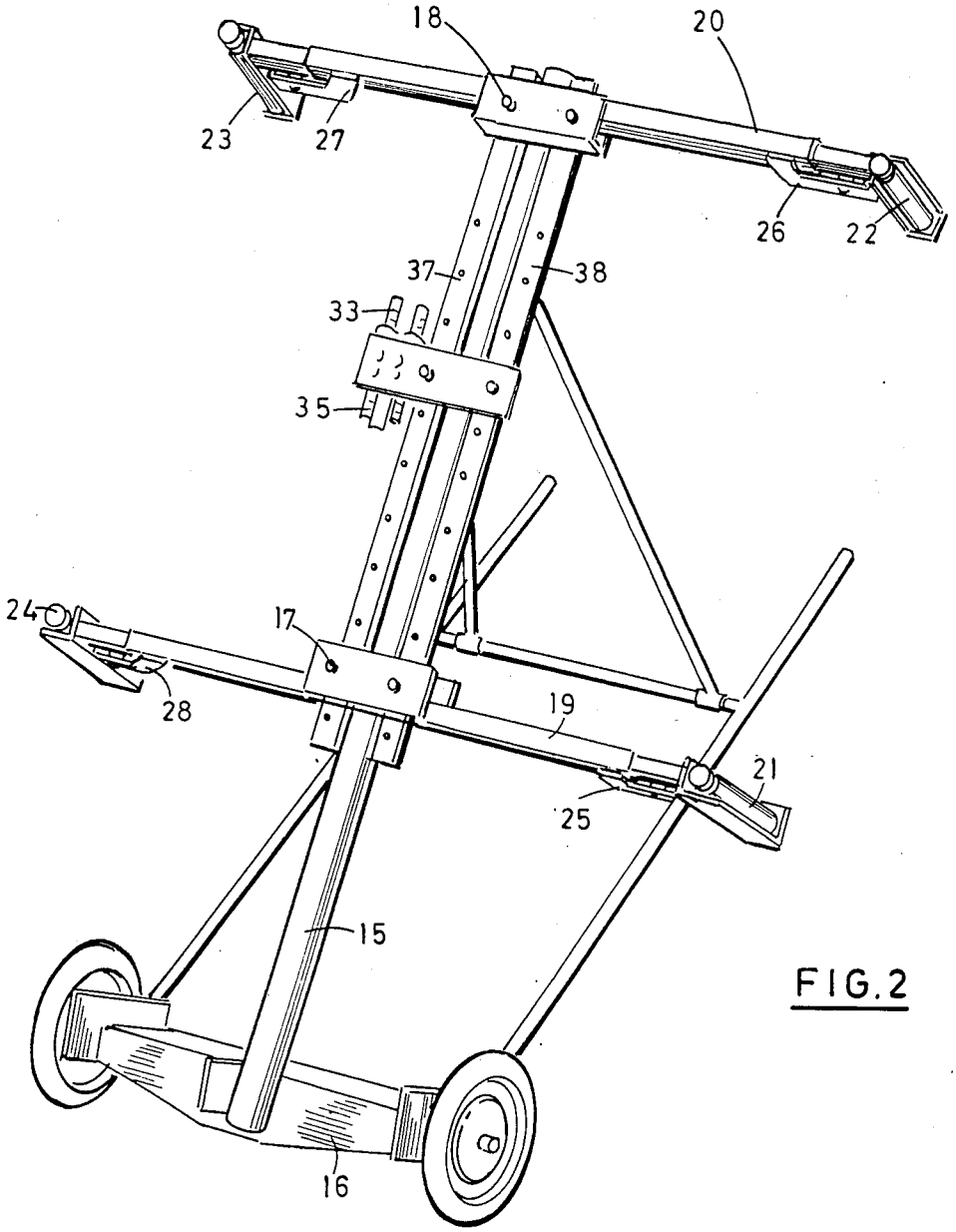
Figure 3:
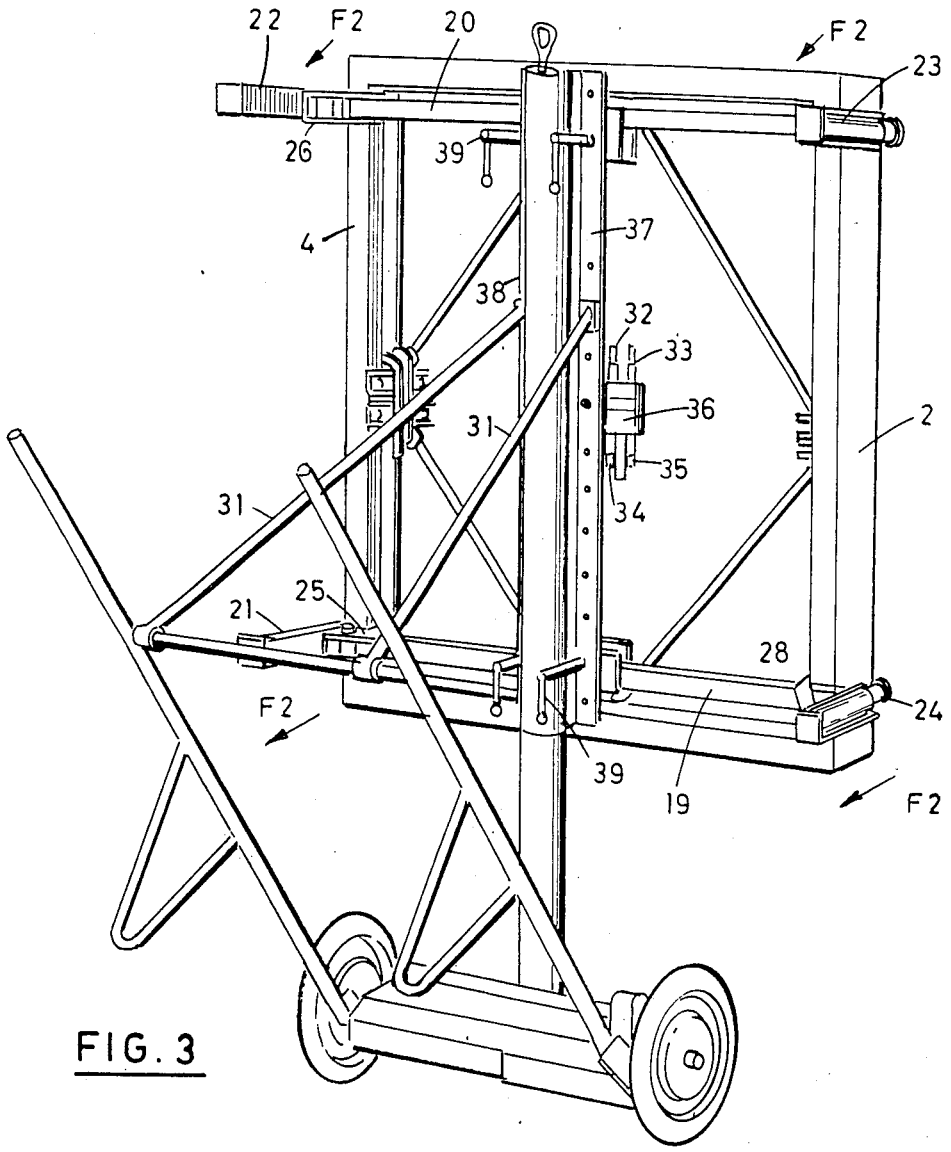
Figure 4:
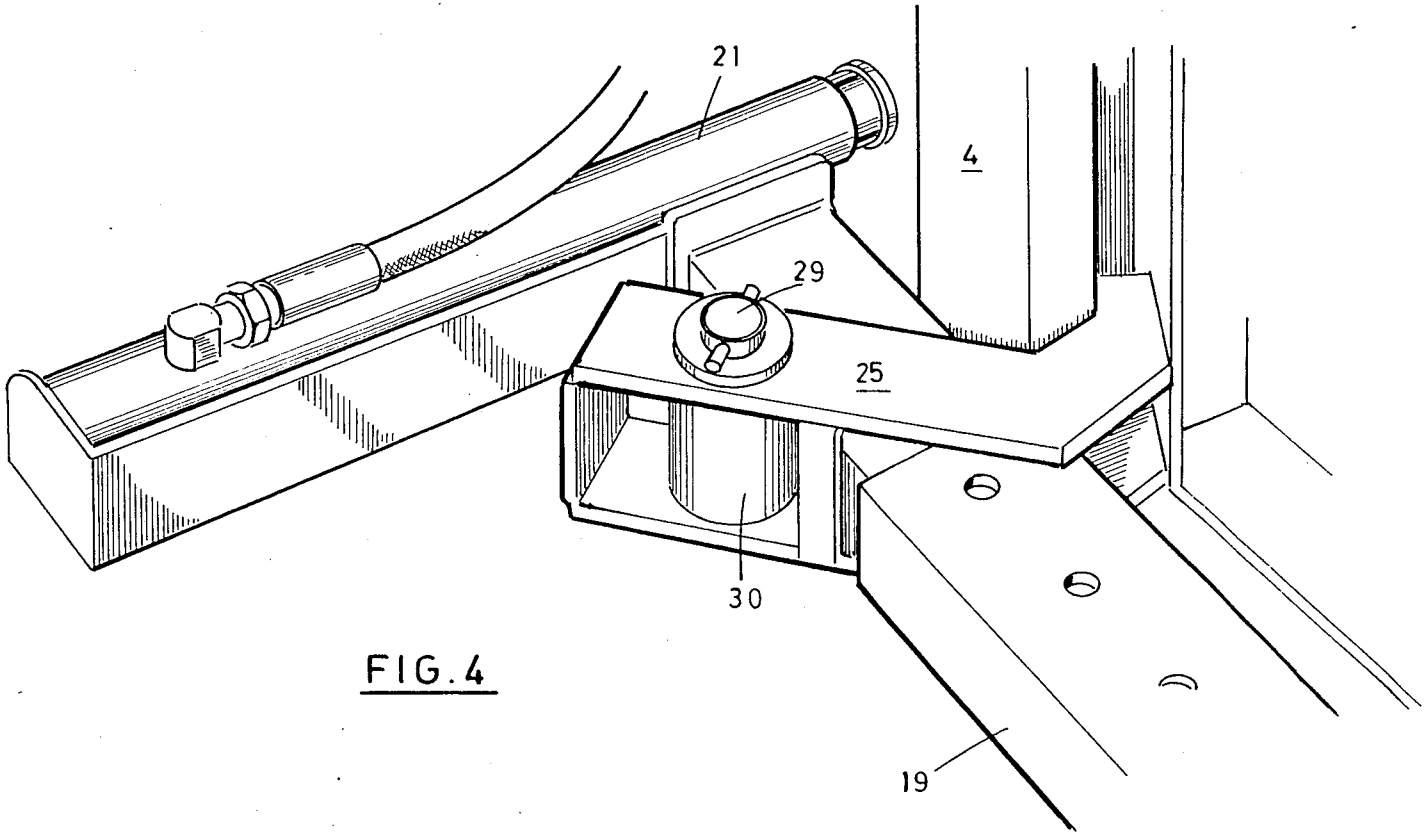
Figure 5:
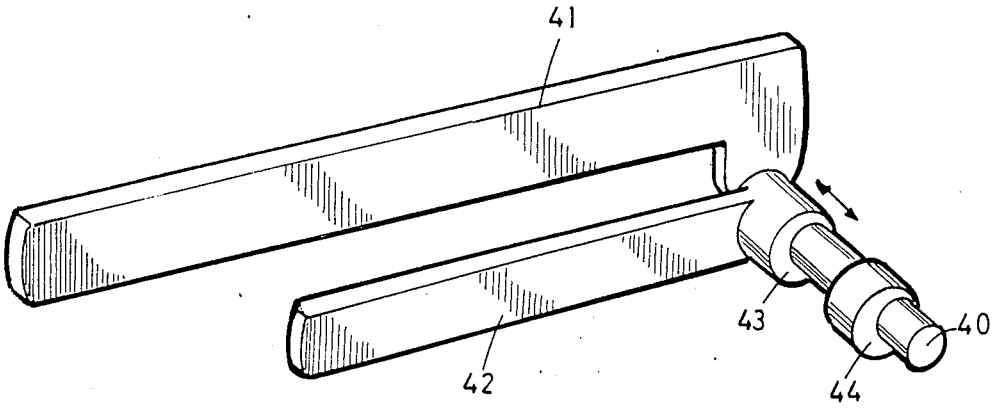
Figure 6:
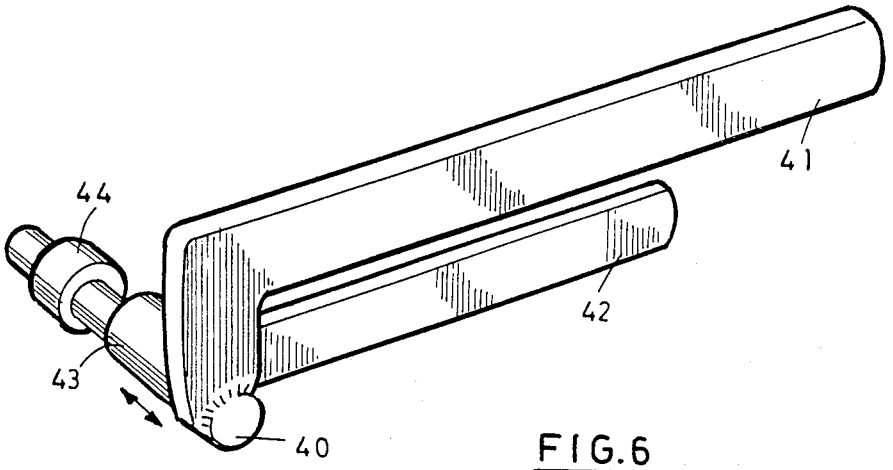
Figure 8:
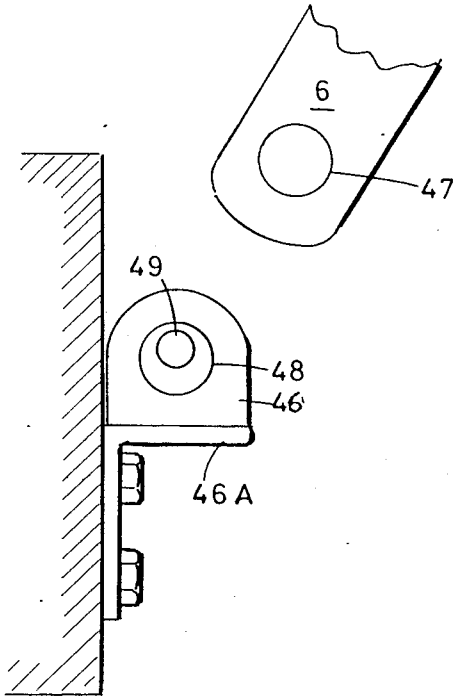
Figure 7:
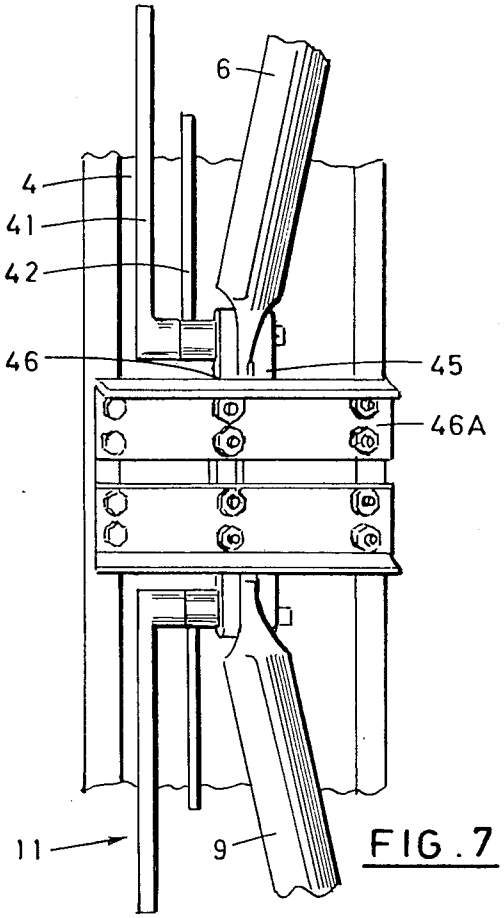

The invention will now be described in detail with reference to the accompanying drawings, on which FIG. 1 is a perspective view of the form in accordance with the invention FIG. 2 is a perspective view of the stand for releasing the form FIG. 3 illustrates the stand in position for loosening the form FIG. 4 is a perspective view of a detail in the stand FIG. 5 is a perspective view of two levers included in the form in FIG. 1, seen from one side FIG. 6 is a perspective view of the same levers seen from the other side FIG. 7 is a perspective view of the levers in FIGS. 5 and 6, mounted on the end of their repective tension bars and FIG. 8 is a side view of the upper holder for the tension bar illustrated in FIG. 7.

FIG. 1 illustrates a form intended for making a window opening in a cast wall. Before casting the wall the form is placed at the desired height with the plane surface facing away from the observer in contact with an unillustrated shuttering wall forming the outside of the finished wall. After a suitable number of forms in accordance with the invention have been placed against the unillustrated shuttering wall, a shuttering wall, forming the inside of the finished wall is placed into contact with the chief plane facing towards the observer of the forms in accordance with the invention, and concrete is poured in between the shattering. After striking the unillustrated shuttering, the forms in accordande with the invention are thus cast into the wall and the technical task to be solved by the invention is now to remove the forms from the openings without damaging the forms or the concrete surface. To do this it should not be necessary to dismantle the form, so that after it has been taken out of the opening it can be used once again.

The inventive form comprises four bars 1, 2, 3, 4 of aluminium with a substantially U-shaped cross section. The exterior surface of the form is flat and clad with sheets 5 of a material having a low coefficient of friction, e.g. teflon, PVC-plastics or some other smooth material. In the illustrated embodiment, the outer contour of the form is quadratic, but it may be rectangular or round. The exterior surface of the form may have positive relief but may also be square to the finished wall, i.e. it may lack relief, in accordance with the present invention. Four adjustable tension bars 6, 7, 8, 9 are fixed inside the form in a configuration of the kind illustrated. As will be seen from the Figure, each tension bar is pivotably mounted in adjacent bars and at one end of each tension bar there is an operating means, in the illustrated embodiment depicted as an eccentrically mounted disc, with the aid of which the distance between the fixing points of the tension bar in the two adjacent bars may be adjusted. The operating members 10, 11 of the bars 6 and 9 are situated centrally on the vertical bar 4, while the operation members 12, 13 of the bars 8, 9 are situated centrally on the opposite vertical bar 2. The other ends of the tension bars 6 and 7 are pivotably mounted in holders arranged centrally on the horizontal bar 1 and in a corresponding way the other ends of the tension bars 8 and 9 are pivotably mounted in holders arranged centrally on the lower horizontal bar 3. When the inventive form has been cast in, the operating means 10–13 are set so that the distance between the fixing points for the tension bars 6–9 is maximum. When the form is loosened, the operating means 10–13 are turned so that the respective eccentrically mounted disc reduces this distance, whereby the bars 1–4 are deflected inwards and relinguish the concrete wall surfaces in the opening formed. The concave elastic deformation of the form size is schematically illustrated by the dashed lines 14. It will thus be understood that release from the wall surfaces of the opening formed will be maximum at the fixing points of the tension bars in the form and minimum at the corner areas of the form.

The deformation forces caused by the tension bar 6 are denoted by Fl. Corresponding forces are obtained from the other tension bars 7–9. These forces are thus in or parallel to the main plane of the form and are directed inwards from the sides thereof.

To withdraw the form from the opening created in the wall, the apparatus illlustrated in FIG. 2 is used, this comprising a column 15 in telescopic sections and downwardly carried by a truck or trolley 16. The column is provided with two transverse holders 17, 18 adjustable in height along the column and carrying their respective beams 19, 20. The length of each beam 19, 20 is adjustable, e.g. by the use of telescopic sections. At the end of each horizontal beam there is a hydraulic cylinder disposed as illustrated, i.e. it extends at right angles to the longitudional axis of the beam. The cylinders are denoted by the numerals 21, 22, 23 and 24. Spaced inwards of each hydraulic cylinder there is a claw pivotably mounted on the respective horizontal beam in a manner more closely illustrated in FIG. 4. These claws are denoted by the numerals 25, 26, 27 and 28. Each claw has the shape of a fork with two legs, which are pivotably mounted on a pivot pin 29 (see FIG. 4) extending through a sleeve 30 welded to the telescopic section of the horizontal beam 19 or 20. The free end of each leg has the shape of an arrow head the rear portion of which is intended to grip behind the leg of the U-shaped beam 2 or 4 in a manner described in detail below.

FIG. 3 illustrates the stand in position for withdrawing the form from the finished wall opening. The heigts of the beams 19 and 20 are set along the column and the length of the respective beam is adjusted so that each hydraulic cylinder is on the outside of the form a distance in on the ready-cast wall, and each claw 25–28 is hooked behind the form bars 2 and 4 against the leg facing towards the observer of the respective bar. After striking the shuttering used to make the finished wall, the operating members 10–13 are turned so that the distance between the fixing points of each tension bar will be minimum, whereby the form is deformed and the frame bars loosen from the wall surfaces of the opening. The members 10–13 are then turned back again to their original positions (maximum distance between the fixing points of the tension bars), the form then returning to its shape illustrated by full lines in FIG. 1. Since the bars 1–4 have been loosened from the walls of the opening to a less extent at the corner portions thereof than at the centre of the respective sides, where the distance between the deformed bar and the finished wall is maximum, as will be seen from the concave dashed lines 14 in FIG. 1, it is suitable to place the hydraulic cylinders and gripping claws at the corner portions of the form in the manner illustrated in FIG. 3. It will also be seen from FIG. 3 that the column 15 at its upper portion is tied to the trolley 16 with the aid of two struts 31. Hydraulic fluid is pumped from an unillustrated pump simultaneously to each of the cylinders 21–24, their rams the thrusting out and into engagement with the inner surface of the cast wall. Continued movement of the rams result in that the claws 25–28 pull the form out of the opening and in the vicinity of each cylinder the action there of causes the form to be subjected to a force F2 directed at right angles to the chief plane of the form. A hydraulic fluid line goes to each hydraulic cylinder from an unillustrated destribution valve, to which the hydraulic pump is connected. The hydraulic lines are indicated schematically at 32, 33, 34 and 35. There is a hydraulic valve in each line allowing individual operation of each hydraulic cylinder 21–24. These valves are arranged on a panel 36, easily accessible to the operator. It is also apparent from FIGS. 1 and 3 how the height of the horizontal beams 19 and 20 is adjustable by coaction between the holders 17, 18 and rails 37, 38 attached to either side of the column 15, the rails being provided with through holes at uniform spacing. With the aid of the bolts 39 provided with handles, the holders 17 and 18 can be adjusted in height along the rails 37, 38.

The operating member 10 is illustrated in FIGS. 5 and 6. Remaining operating members 11, 12, and 13 are identical to the one illustrated in FIGS. 5 and 6 and are therefore not described further. The member 10 includes a shaft 40, a first lever 41 welded to one end of the shaft, a second lever welded to a first disc 43, which is eccentrically mounted on the shaft and rotatable relative the shaft 40, and a second disc 44 eccentrically and unrotatably mounted on the shaft 40. The disc 43 may also glide along the shaft 40, as indicated by the arrows in the figure.

The function of the operating member 10 is explained with reference to FIGS. 7 and 8. The end of the tension bar 6 is unrotatably mounted between two bearing lugs 45, 46, which are welded to angle-section holder 46A extending transverse the bar 4. The end of the tension bar is flat and has a through hole 47 (FIG. 8). The bearing lug 46 has a through hole 48 and the bearing lug 45 has a through hole 49. As will be seen, the holes 48 and 49 are not concentric. The disc 44 is between the bearing lugs 45 and 46 and coacts with the hole 47 in the tension bar and has substantially the same diameter as this hole. The end of the shaft 40 facing away from the lever is mounted in the hole 49 in the bearing lug 45 with a given clearance. It will thus be understood that on turning the lever 41 the eccentrically mounted disc 44 will move the tension bar reciprocally in its longitudional direction, and this movement will be taken up by the mentioned elastic deformation of the bars 1–4. The disc 43 coacts with the hole 48 in the bearing lug 46 and has substantially the same diameter as this hole. For each setting position of the lever 41 it is thus possible to lock it in this position by turning the lever 42, the shaft 40 thus being slightly skewed and by wedging action the disc 43 locks the shaft 40 against rotation so that the lever 41 cannot be turned.

The locking effect can also be explained in the following manner. Since the opening 49 is displaced relative the centre of the opening 48, the eccentric disc 44 unrotatably mounted on the shaft 40 can be thrust in between the bearing lugs 45, 46 (only from the left in FIG. 7, as a consequence of the diameter relationships between the shaft and the disc 44) and in through the hole 47 only if the shaft 40 assumes a single predetermined angular position relative the bearing lugs. When the eccentric disc is actually between the bearing lugs 45, 46 (the width of the disc is less than the distance between the bearing lugs 45, 46, and is preferably just as great as the width of the end of the tension bar 6). The shaft 40 can then be turned freely in the bearing by turning the lever 41. Similarly, the disc 43 can then only be inserted in its bearing hole 48 only if the disc 43 assumes a single predetermined angular position relative the bearing lug 46. When the disc 43 has actually been inserted in its bearing hole 48 (by being thrust along the shaft 40), continued turning of the disc 43 in either direction results in that the shaft 40, due to its clearance in the hole 49, is skewed by the disc 43 and locked in the angular position it then has.

Although the operating member 10 and particularly the lever 42, acting as a locking means with its disc 43 eccentrically mounted in the hole 48, have been discribed in connection with their use in a form, it will be seen that they can also be used in apparatus in other technical fields, where it is desired to lock a shaft and/or an eccentric means a desired angular position.

The embodiment of the invention illustrated above can be modified and varied in many ways within the scope of the inventive concept.

We claim:

1. Apparatus for use in making an opening in a concrete structure utilizing a re-usable form which is cast into said concrete structure and removed therefrom when the concrete has hardened, the form including a frame which extends in a main plane and includes an external peripheral surface and an interior peripheral surface and means coupled to said frame for applying a first force at selected first locations along said interior peripheral surface and substantially parallel to said main plane and directed from said peripheral surfaces inwardly from said frame for achieving separation of said form from said concrete structure at said opening, said apparatus further including a stand for coupling to said form, said stand comprising a vertical support column, two verically spaced substantially horizontal beams, the length of each beam being adjustable, a claw member positioned near the ends of each of said beams for grasping said frame at separate places along its periphery, and power means in the form of hydraulic cylinders positioned relative to said claw members for coming into engagement against said concrete structure to apply a second force substantially in a plane normal to said main plane for withdrawing said form from said opening.

2. Apparatus as claimed in claim 1 wherein each of said claw members is pivotally mounted at a distance inward of an end of a respective of said beams and wherein one of said hydraulic cylinders is arranged at each of said ends.

* * * * *